United States Patent [19]

Holahan et al.

[11] 4,261,564

[45] Apr. 14, 1981

[54] PRACTICE APPARATUS FOR PUNTING, PASSING OR KICKING A BALL

[75] Inventors: Edward T. Holahan, Chicago; Burton C. Meyer, Downers Grove; Donald A. Rosenwinkel, Tinley Park, all of Ill.

[73] Assignee: Marvin Glass & Associates, Chicago, Ill.

[21] Appl. No.: 79,342

[22] Filed: Sep. 27, 1979

[51] Int. Cl.³ ..... A63B 67/00

[52] U.S. Cl. ..... 273/55 B; 273/185 C; 273/55 R

[58] Field of Search ..... 273/184 B, 185 C, 199 A, 273/200 R, 200 A, DIG. 21, 198, 55 B, 55 R, 87 R, 87 C

[56] References Cited

U.S. PATENT DOCUMENTS

| | | | |
|---|---|---|---|
| 1,229,309 | 6/1917 | Morse | 273/185 C |
| 2,052,988 | 9/1936 | Procter | 273/185 C |
| 3,031,889 | 5/1962 | Magozanik | 273/200 R |
| 3,088,322 | 5/1963 | Marggraff | 273/185 C |
| 3,324,726 | 6/1967 | Turczynski | 273/184 B |
| 4,118,032 | 10/1978 | Koblick | 273/185 C |
| 4,139,197 | 2/1979 | Windall | 273/200 A |

*Primary Examiner*—Richard C. Pinkham
*Assistant Examiner*—T. Brown
*Attorney, Agent, or Firm*—Mason, Kolehmainen, Rathburn & Wyss

[57] ABSTRACT

Practice apparatus for use in measuring azimuth angle, equivalent distance and angle of elevation of a ball that is punted, passed or kicked comprises a base including means for securing the device in fixed position on the ground or other surface. A tether line extends from the base and is connected at a free outer end with the ball which may be kicked from a tee, punted, or passed to extend and exert tension on the tether line. The angle of elevation and/or angle of azimuth of the tether line is increased or changed when the ball is kicked or thrown. The practice apparatus includes a first element for measuring and indicating the angle of elevation of the tether when the ball is moved away from a starting point by kicking or throwing, a second element for measuring the azimuth angle or direction of the path of movement of the ball and a third element for indicating the equivalent distance that the ball would be moved except for the restraint of the tether line.

9 Claims, 8 Drawing Figures

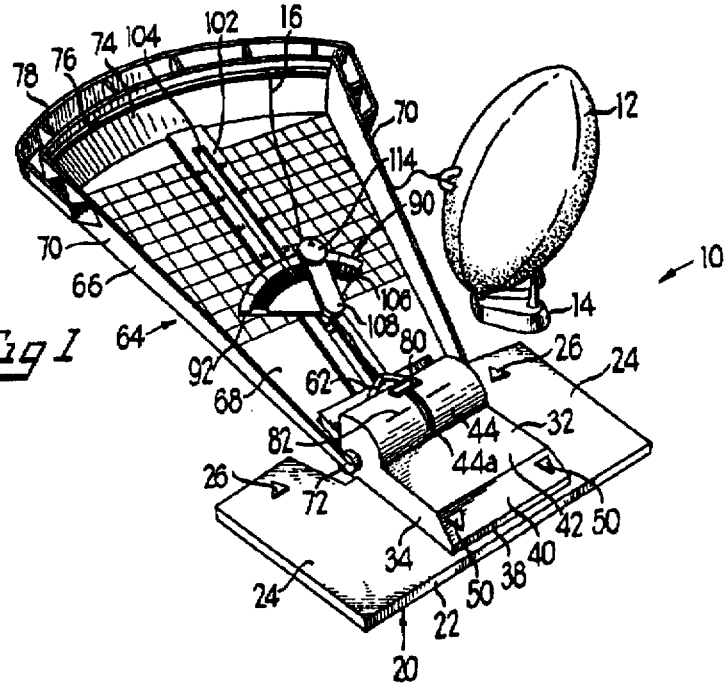
Fig 1
Fig 2A
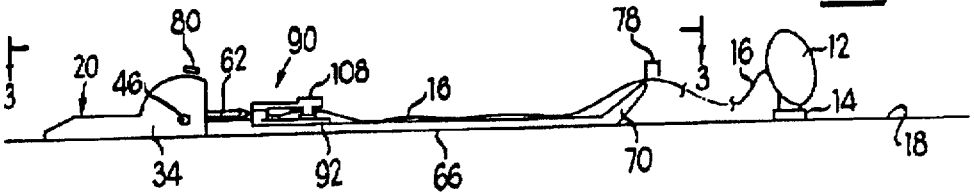
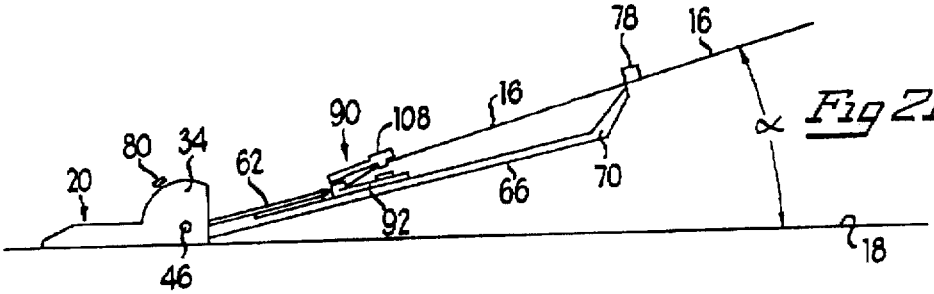
Fig 2B
Fig 2C
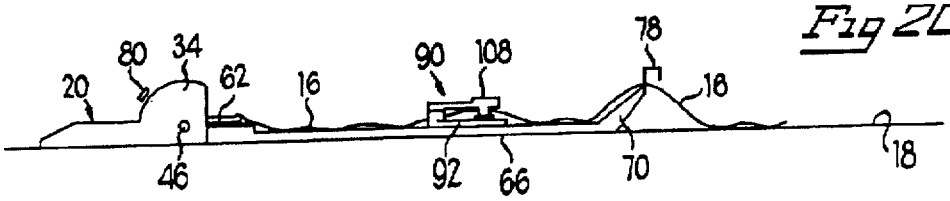

78
74
16
16
126
104
126
130
102a
124
102a
102
124
66
10
130
128
70
102
100
64
70
116
90
94
92a
92
114
106
108
88
22
26
28
28
22
26
16
62
72
80
72
44a
44
24
20
42
32
40
50
50

PRACTICE APPARATUS FOR PUNTING, PASSING OR KICKING A BALL

BACKGROUND OF THE INVENTION

1. Field of the Invention

The present invention relates to a new and improved practice apparatus for measuring the azimuth angle, equivalent distance, and the elevation of the path of a ball or other projectile that is punted, passed or thrown. More particularly, the invention relates to a device of the character described which is useful in perfecting the skills of punting, passing and kicking a football without requiring someone to retrieve the ball and without requiring a large amount of area or practice space.

2. Description of the Prior Art

A number of different and widely variant practice devices and game devices have been developed for use in practicing or playing ball games like golf. U.S. Pat. Nos. 2,032,081; 2,230,282; 3,324,726; 3,430,493; 3,494,621; and 41,139,197 disclose various types of these devices.

OBJECTS OF THE PRESENT INVENTION

It is an object of the present invention to provide a new and improved practice apparatus for measuring the azimuth angle, an equivalent distance and the angle of elevation of a projectile such as a ball that is punted, passed or kicked.

More particularly, it is an object of the present invention to provide a new and improved practice apparatus of the character described which provides an indication of distance and accuracy without requiring a large amount of space or the need of another person for measuring these values.

Another object of the present invention is to provide a new and improved practice apparatus of the character described which is useful with a football that may be punted, passed or kicked.

Another object of the present invention is to provide a new and improved practice or game apparatus of the character described which provides an accurate measurement of the azimuth angle, an equivalent to distance and an elevational angle of the path for a ball propelled from a starting location by kicking or throwing from a starting point.

Yet another object of the present invention is to provide a practice apparatus of the character described which includes means for measuring and indicating the parameters of azimuth angle, elevational angle and equivalent distance.

Yet another object of the present invention is to provide a new and improved practice apparatus which can be readily reset for successive operations and which is able to achieve a high degree of accuracy.

Still another object of the present invention is to provide a new and improved practice apparatus of the character described which is useful for measuring and indicating the parameters of azimuth angle, elevational angle and equivalent distance for a ball that is thrown, hit, or kicked from a starting position or location.

Yet another object of the present invention is to provide a new and improved practice apparatus which is capable of indicating the amount of lateral deviation in linear measurement of a ball away from an intended line or path of movement.

Yet another object of the invention is to provide a new and improved practice apparatus of the character described which is useful for training a place kicker, a punter, or passer in the game of football.

Yet another object of the present invention is to provide a new and improved practice apparatus of the character described which is economical to produce, easy to use and which lends itself to production by mass production techniques.

SUMMARY OF THE INVENTION

The foregoing and other objects and advantages of the present invention are accomplished in an illustrated embodiment comprising a new and improved practice apparatus for measuring the azimuth angle, equivalent distance and the angle of elevation of the path of a projectile such as a football which is punted, passed or kicked from a starting location adjacent the apparatus. The apparatus includes a base having means for securing the same in a fixed position on the ground or other surface and a tether line is connected between the base and the football and is subjected to tension when the football is punted, passed or kicked to move away from the starting location. The apparatus includes a first measuring device mounted on the base for pivotal movement about a horizontal axis and connected to be elevated by the tether line when the line is tensioned and elevated by movement of the football away from the starting position when kicked or thrown. Second measuring means is mounted for pivotal movement about an upstanding axis and is interconnected with the tether line for indicating the azimuth angle of the line when fully tensioned. A third measuring element is provided for indicating the amount of tension exerted on the tether line and thus provides an equivalent distance measurement factor. The device is adapted to be fabricated from molded pastic material and is provided with calibrations so that the angles may be easily read and the distance equivalents are also indicated.

BRIEF DESCRIPTION OF THE DRAWINGS

FIG. 1 is a perspective view of a new and improved practice apparatus of the character described constructed in accordance with the features of the present invention and illustrated in position ready for use;

FIG. 2A is a side elevational view of the apparatus shown in a ready position before a football is kicked;

FIG. 2B is a side elevational view of the apparatus illustrated in another operative position wherein the tether line is tensioned in an elevated position caused by kicking of the ball;

FIG. 2C is yet another side elevational view of the apparatus in another operative position after the ball has come to rest;

DESCRIPTION OF THE PREFERRED EMBODIMENT

Figure 3:
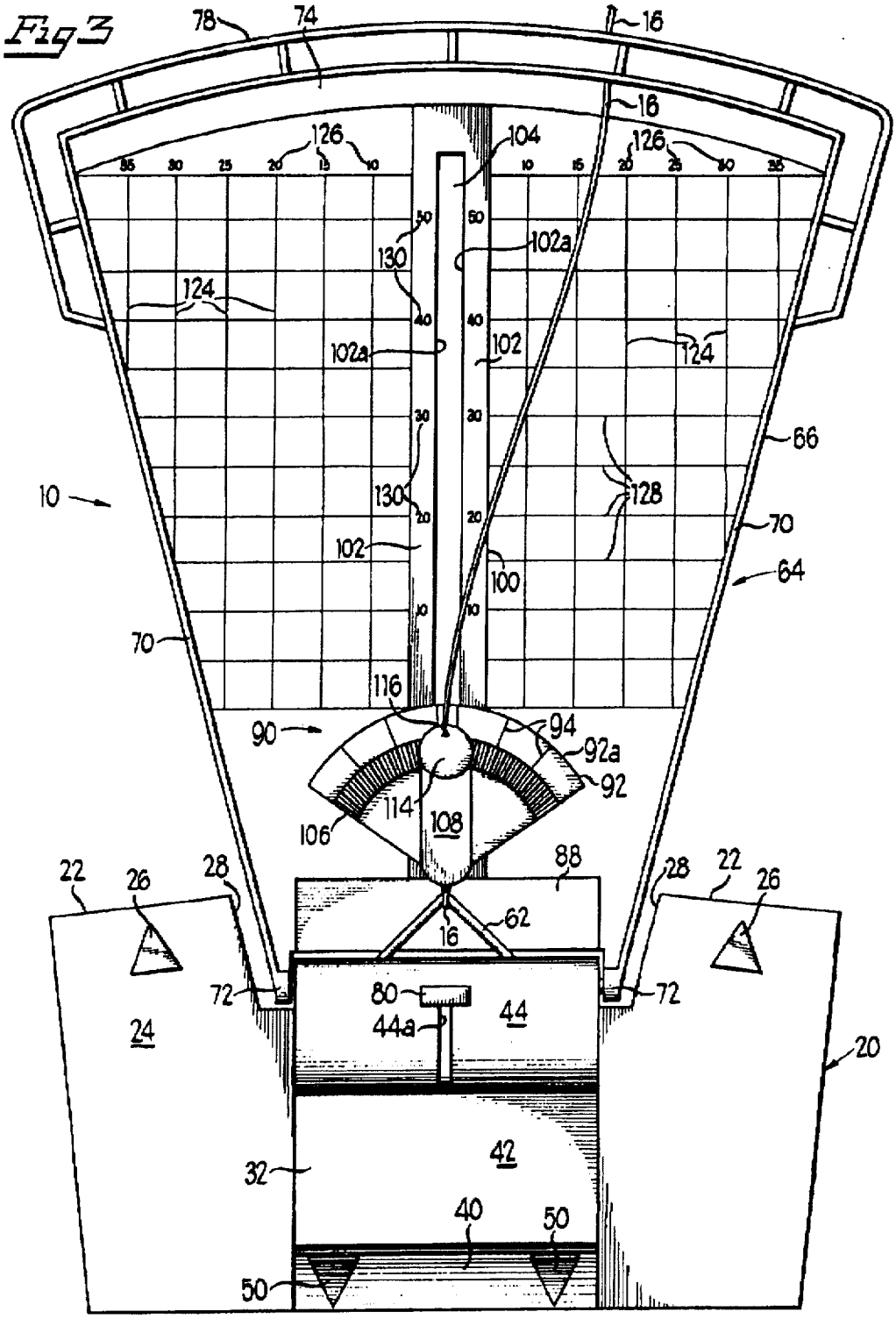
FIG. 3 is an enlarged top plan view of the practice apparatus looking in the direction of arrows 3—3 of FIG. 2A.

Referring now more particularly to the drawings, in FIG. 1 is illustrated a new and improved practice apparatus especially adapted for measuring the azimuth angle, an equivalent distance and the angle of elevation of the path of a projectile such as a football which is punted, passed or kicked from a starting position adjacent the apparatus. The apparatus is referred to as a whole by the reference numeral 10 and is used in conjunction with a football 12 which may be kicked from an upright portion resting on a kicking tee 14 or which may be punted or passed from a starting position adjacent the apparatus and aligned in selected relationship or orientation with respect thereto.

The apparatus is also useful with other sports such as golf or baseball and is generally useful with any sport or game wherein a ball or other projectile is moved by the hand, foot or implement such as a club head, bat or racket from a starting position toward a desired path of travel or toward a target or other objective.

A football 12 is secured by means of a flexible, elongated, tether line 16 so that the ball will not have to be chased or retrieved and will not go beyond a relatively limited range from the starting location adjacent the apparatus. Normally, the apparatus is positioned on a chalk line or other marker on the ground or other supporting surface 18 (FIGS. 2A, 2B and 2C).

When the football 12 is moved or displaced from the starting location on the tee 14, by place-kicking, it is desirable to measure the path traveled by the football in terms of azimuth angle relative to the chalk line and as elevational angle above the grass. It is additionally desirable to obtain an indication of the strength of the kick or throw which results in a factor related to and proportional to the distance the ball would otherwise travel if not for the restraint of the tether line 16. For this purpose, the apparatus 10 includes a base 20 having a relatively large flat bottom wall 22 preferably formed of molded plastic material and including a pair of opposite side portions 24 having triangular shaped arrow heads or indicia on the upper surface thereof pointing in the general direction which the football 12 is to be kicked or thrown, normally parallel to a chalk line on the ground. Along the forward edge, the base is formed with notched out recesses 28 and a rectangular shaped central base portion 30 is spaced therebetween as best shown in FIGS. 4 and 5.

Figure 4:
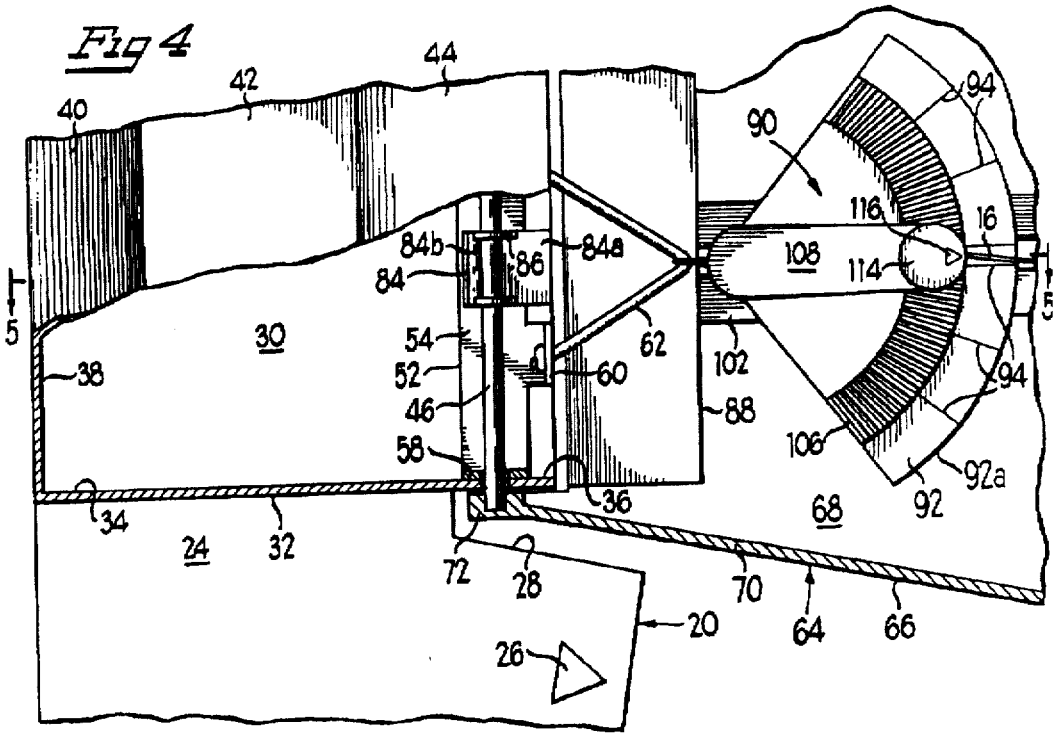
FIG. 4 is a fragmentary top plan view similar to FIG. 3 with portions broken away for clarity.
Figure 5:
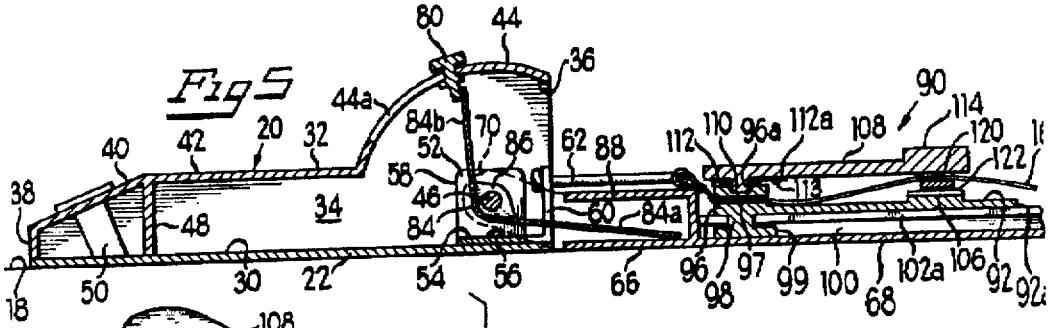
FIG. 5 is a fragmentary longitudinal sectional view taken substantially along lines 5—5 of FIG. 4.

Above the center section of the bottom wall, there is provided a hollow housing portion 32 having a pair of vertically extending opposite side walls 34 with an enlarged forwardly facing opening 36 at the front end thereof as best shown in FIGS. 4 and 5. The housing includes a rear end portion comprising a relatively short vertical end wall 38 and a sloped lower portion 40 which joins a flat top wall portion 42.

At the forward end of the housing there is provided a cylindrically curved top wall segment 44 and the surface thereof is coincident with a cylinder having a horizontal axis of generation coincident with a pivot shaft 46 extending between opposite sidewalls 34 and projecting outwardly through openings therein as shown in FIG. 4. The housing 32 includes an internal stiffening rib 48 which divides the housing into a rearward compartment adjacent the sloped rear corner wall 40.

In accordance with the invention, the base 20 is adapted to be secured in fixed position on the ground surface 18 by one or more elongated stakes 50 having elongated, sloping shanks which extend through openings in the sloped rear corner wall 40 and the bottom wall 30. Each stake is formed with a triangular or arrow shaped head which, as illustrated in FIGS. 1 and 3, is directed to point in a direction opposite to the forwardly pointing arrow heads 26. As shown in FIG. 5, the stakes 50 are adapted to secure the base 20 against a forward movement when tension is exerted on the tether line 16 by the football 12.

The horizontal pivot axle 46 is additionally supported in the housing 32 by a U-shaped bracket 52 formed of metal and having a base or bight portion 54 secured to the bottom wall 30 by a suitable fastener 56. The bracket includes a pair of upstanding legs 58 adjacent inside surfaces of the side walls 34 and the legs are formed with openings for accommodating outer end portions of the pivot axle 46 as shown in FIG. 4. The bracket 52 also includes a pair of upstanding legs 60 aligned with the forward opening 36 of the housing and disposed on opposite sides of the longitudinal center line of the apparatus, which line is aligned on or parallel of a chalk line on the ground and is designated by the section lines 5—5 of FIG. 4.

Each leg is formed with an opening therein through which is extended one end portion of an elongated elastic shock cord 62 with a knot formed on the inside surface of the leg 60 to prevent the shock cord from pulling through the opening therein. As illustrated in FIG. 4, the legs of the shock cord form a V-shaped elastic element and the inner end of the tether cord 16 is tied thereto.

When tension or pull is exerted on the tether 16 by throwing or kicking the football away from the starting or rest position generally forwardly of the apparatus along the chalk line, the shock cord legs are elongated and extend outwardly from the forward open end 36 of the base housing 32. When momentum of the football is arrested, the elasticity of the shock cord then retrieves a portion of the tether line 16 back into the apparatus and the shock cord contracts to a normal condition as indicated in FIGS. 1, 2A, 2C and 3 to 5, back from the extended or tensioned condition illustrated schematically in FIG. 2B which obtains when the football 12 reaches the maximum extent of the tether distance and elevation away from the practice apparatus.

In accordance with the present invention, the practice apparatus includes a first measuring and indicating assembly indicated by the reference numeral 64 for providing an indication of the angle of elevation or height that the football 12 achieves during its flight away from the starting position when kicked, passed or punted. This assembly includes a pan-like body 66 having a generally trapezoidal or pan shaped bottom wall 68 and supported for pivotal movement about a horizontal axis by the outer end portions of the pivot axle 46. The pan-like body includes a pair of divergent opposite side walls 70 which are formed with rounded cylindrical bosses 72 pivotally interconnected to the outer end portions of the axle 46 as shown in FIGS. 1, 3 and 4. The pan-like body 66 also includes an arcuately curved outer end wall 74 having an upper edge defining the bottom of an elongated arcuate recess 76 which defines a slot for the tether cord 16 to pass through with as little restraint as possible relative to an azimuth angle range defined between outer limits posed by the side walls 70. The upper edge portion of the slot 76 is formed by an arcuate lifting rib structure 78 having opposite end portions extending inwardly along and integrally joined with the side walls 70 as best shown in FIG. 3.

Because the lifting rib structure 78 is spaced above the tether line 16, when the tether line is tensioned and elevated by the flight of the football 12, the outer free edge of the light in weight, pan-like base 66 is pivoted about the axis of the pivot axle 46 from the position shown in FIGS. 2A and 2C to the position shown in FIG. 2B and angle of elevation or extent of this pivotal action is determined by the height or trajectory of the path of the football when it is passed, punted or kicked.

In order to measure and provide an indication of the maximum angle of elevation ($\alpha$ in FIG. 2B) achieved by the football, the apparatus includes an elevation marker and indicator button that is mounted for movement along an arcuate slot 44a aligned along the longitudinal axis of the apparatus and formed in the cylindrically curved, forward top wall section 44 of the housing 32. The marker 80 is moved from a starting position of FIGS. 1, 2A, 2C and 5 at the forward end of the slot toward an elevation angle indicating position nearer a rear end of the slot and the amount of movement indicates the maximum angle of elevation that was obtained. Accordingly, the position of the marker is indicative of the height of the throw or kick. As illustrated in FIG. 1, the outside or top surface of the curved top wall 44 is provided with one or more scale marks 82 which indicate a desirable angle of elevation for a place kick and other scale marks may be provided if desired for indicating on a graduated angular basis, the angle of elevation achieved by the football in flight.

Referring to FIGS. 2A, 2B and 2C, the football 12 is kicked or thrown from a starting position with the tether line 16 in a slackened condition and moves along elevated flight path above the earth's surface 18 until the line becomes tensioned to extend and stress the shock cord 62. At the top of the flight path, the line assumes an angle of elevation $\alpha$ above the surface as shown in FIG. 2B. When the momentum of the ball is arrested by tensile forces acting via the tether line, the ball then drops back to the ground and the shock cord returns to the normal position with the tether line in a slackened condition as illustrated in FIG. 2C. During this process, the elevation angle indicator button 80 is moved from the starting position of FIG. 2A rearwardly in the arcuate slot 44a to an angle indicating position as shown in FIG. 2B and finally comes to rest in a final indicating position as shown in FIG. 2C which provides an accurate direct indication of the maximum angle of elevation that the football or other projectile achieved on its path of flight from the starting position. The marker lines 82 may represent an ideal angle of elevation for a place kick and if the indicator button comes to rest aligned with these lines, it is indicative that a desirable place kick trajectory has been achieved by the kicker. If the marker button is forward of the line, it is indicative that the kick will be too low and if the marker is rearwardly of the marker line, it is indicative that the angle of projectory or elevation alpha is too high or above the desired projectory angle.

When the ball is punted or passed, the marker lines 82 may have little use however, other marking scale lines may be provided if desired, to indicate the quantitative amount of angular elevation of the flight path of the ball. The marker 80 may be manually reset by sliding it forwardly in the slot 44a and the process is then repeated.

In order to move the elevation angle indicator button 80, the measuring assembly 64 includes a generally L-shaped lever 84 mounted for pivotal movement on the pivot axle 46 by means of a pair of apertured brackets 86 at the corner of the lever which has a forwardly extending leg 84a and an upstanding leg 84b for engaging the marker button as shwon in FIG. 5. The marker moves rearwardly in the slot 44a whenever the forward edge of the pan-like body 66 is pivoted upwardly as shown in FIG. 2B by elevation and tension of the tether line 16. When tension on the tether line is subsequently relaxed, gravity causes the pan-like body 66 to return to the horizontal position of FIGS. 2A and 2C but the marker button 80 remains at rest in a position where it has been moved in the slot 44a by the upstanding leg 84b. The leg itself, however, returns to a starting position and pivots in a clockwise direction as permitted by the forwardly extending leg 84a when the pan bottom 68 returns to a horizontal position on the ground surface 18. An integral enclosure or housing 88 of L-shaped transverse cross-section as shown in FIG. 5 is provided to enclose the forwardly extending leg 84a of the lever and the underside of the top wall of this housing acts to bias the forward leg downwardly when the pan-like body 66 drops back from an angularly elevated position to a horizontal or rest position. The top wall of the housing provides a convenient support for the elastic cord 62 and the tether cord 16 which rest on the top surface thereof as shown in FIGS. 4 and 5.

Figure 6:
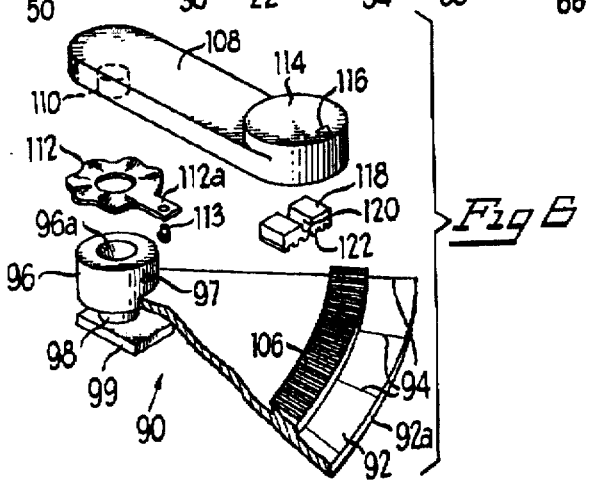
FIG. 6 is an exploded, fragmentary, perspective view of an azimuth angle measuring assembly of the practice apparatus in accordance with the invention.

In accordance with the present invention, the practice apparatus 10 also includes an azimuth angle measuring and indicator assembly generally indicated by the reference numeral 90. The azimuth indicator is shown in exploded view in FIG. 6 and includes an arc-shaped base element 92 having a circularly curved outer and forwardly facing edge 92a with radial angle marks 94 provided on opposite sides of a central axis normally aligned with the longitudinal axis of the pan-like body 66. At the apex end, the arc-shaped element 92 is provided with an enlarged cylindrical boss 96 having a diametrically disposed aperture extending therethrough indicated as 97 for accommodating the tether line 16 which extends through the opening from the elastic shock cord 62 in a forward direction normally aligned with a longitudinal axis of the practice apparatus 10 indicated by the section lines 5—5 in FIG. 4. The boss 96 includes a downwardly depending spindle portion 98 of reduced diameter with an integral, enlarged key element 99 of rectangular shape at the lower end. The key element is mounted for longitudinal sliding movement within a guideway 100 integrally formed on the upper surface of the bottom wall 68 by a pair of opposite, spaced apart, ribbed side walls 102. Parallel facing edges on the ribbed, side walls designated by the numeral 102a form opposite sides of a linear, elongated slot 104 which accommodates the reduced diameter spindle portion 98 during reciprocal sliding relative movement of the assembly 90. The underside of the arc-shaped base 92 rests on the upper surface of the side walls 102 as illustrated in FIG. 5 and the upper surface of the arc-shaped base is provided with circumferentially disposed strip of radially orientated ridges and grooves designated 106 which extend radially inwardly of the outer free edge 92a as best shown in FIG. 6. The ridges and grooves 106 are in radial alignment with the central axis of the boss 96 and shaft 98 and along with the radial marker lines 94 provide an indication of angular azimuth movement with respect to the longitudinal axis represented by the section lines 5—5 in FIG. 4 of the apparatus.

In accordance with the present invention, a marker arm 108 is supported for pivotal movement relative to the upstanding axis of the cylindrical boss 96. The boss includes an aperture 96a in the upper surface thereof for receiving a cylindrical pivot pin or axle projection 110 formed on the underside of the indicator azimuth arm 108 adjacent a rearward end portion thereof. An undulated retaining washer 112 is disposed between the upper surface of the boss 96 and the underside of the azimuth marker arm 108 around the pivot projection 110 and the washer includes a forwardly extending arm portion 112a secured to the underside of the azimuth arm 108 by a small fastener screw 113. At the forward end, the azimuth marker arm is provided with enlarged upstanding cylindrical boss or knob 114 having a forwardly pointing arrow head indicia 116 on the upper surface thereof. The arrow head indicia is aligned to point in the same direction as the longitudinal axis of the azimuth arm.

A tether line guide 118 is mounted on the underside of the arm below the knob 114 at the forward end and this guide includes a slot 120 forming a passageway for the cord or tether line 16 to pass therethrough and thereby align and lift the azimuth marker arm away from the ridges and grooves 106 when the tether line is under tension and is elevated as illustrated in FIG. 2B. The guide 118 includes a plurality of ridges and grooves 122 on the underside thereof adapted to mesh with the ridges and grooves on the arc-shaped base 92 and the interfitting ridges and grooves retain the azimuth arm 108 in a position indicative of the angle of deviation or azimuth of the tensioned and elevated tether line 16 with respect to the longitudinal axis of the apparatus. As illustrated in FIG. 2B, when the tether line is under tension and is elevated by the flight of the ball 12 as illustrated, the teeth 122 on the guide 118 are moved upwardly away from the ridges and grooves 106 on the arc-shaped base 92 and the azimuth indicator arm 108 may then freely pivot into alignment with the tether line 16. The alignment may or may not be aligned with the longitudinal axis of the slot 104 depending on the accuracy of the kick or throw.

Referring now to FIG. 2B, when the football 12 is thrown or kicked, the tether line 16 is elevated to a maximum angle $\alpha$ and is under tension to extend the elastic member 62 as illustrated. It should be noted that the lifting rib structure 78 of the pan-like body 60 is higher than the path of the tether line 16 extending through the groove 120 in the guide 118 on the bottom of the azimuth indicator arm 108. Because of this, tension of the tether line is effective to raise the teeth 122 of the guide out of engagement with the row of ridges and grooves or teeth 106 on the arc-shaped base 92. When this occurs, the indicating arm 108 is then free to pivot about its lower pivot base 110 and may assume an angular position that is aligned with the tether cord. This position may form a straight line position aligned with the slot 104 and when tension is subsequently released on the tether, the teeth 122 on the guide block 118 then re-engage the row of teeth 106 on the base and the azimuth indicating arm is then retained in a position which is indicative of the amount of angular azimuth deviation of the tensioned tether cord. Azimuth angles are measured from either side of the desired longitudinal axis of the practice apparatus 10 which is aligned with the elongated slot 104. The azimuth indicator arm 108 provides a direct reading indication of the amount of angular azimuth deviation of the projected flight path of the football as it is kicked or thrown.

Resetting of the azimuth arm is subsequently accomplished if desired, by grasping the knob 114 and returning the azimuth position of the indicator arm to the centered position as shown. In order to provide another type of measurement or indication of azimuth deviation, the bottom wall 68 of the pan-like body 66 is provided with a plurality of longitudinally extending grid lines 124 and at the outer end, these lines are identified by numerical indicia 126 increasing in value outwardly away from both sides, right and left of the central longitudinal slot 104. To obtain a reading, the position of the indicator arrow head 116 to the right or left of the slot 104 after a throw or kick of the ball has been made is noted and an appropriate distance to the right or left of the center line is read off by lining up the arrow head 116 with the closest longitudinal grid line 124.

The bottom wall 68 of the pan-like body 66 is also provided with a plurality of transverse, spaced apart distance lines 128 which cross the longitudinal grid lines 124 to provide a matrix pattern for easy viewing. These transverse distance measurement lines 128 are associated with the distance measuring system in accordance with the present invention and provide an indication of the distance or range that a ball or other projectile would have moved if not constrained by the tether line 116. The transversely extending distance lines 128 are provided with appropriate indicia 130 on the upper edges of the rib side walls 102 increasing in value outwardly toward the lifting structure 78. When the ball 12 exerts tension and elevates the tether line 16 as shown in FIG. 2B, the elastic element 62 is stretched and because this element is too large to pass through the small diameter aperture 97 in the boss 96, the boss and its attached elements are moved fowardly and guide during this movement by the key member 99 which slides within the key slot 100 defined by the rib side walls 102. As illustrated, the entire azimuth angle measuring assembly 90 thus moves from a starting position closely adjacent the forward open end 36 of the housing 32, along the slot 104 to an intermediate indicator position as shown in FIG. 2B and eventually when the tension on the line is relaxed, the measuring assembly comes to rest at an indicator position intermediate the ends of the slot as shown in FIGS. 1 and 2C.

In the indicating position, the arrow head 16 indicates the distance equivalent by means of the transverse distance lines 128 as well as the azimuth angular deviation as previously described. The azimuth angle measuring assembly 90 is then reset to the original position as shown in FIG. 2A and the process may be repeated for subsequent practice throws or kicks.

From the foregoing it will be seen that the practice apparatus provides a helpful and universal device for measuring the elevational angle, the azimuth angle and a distance equivalent for a football or the like that is moved from a starting position by kicking or throwing or by contact with another implement such as a bat, club or paddle. The practice apparatus is simple and straight forward in construction and operation, economical to produce, easy to read and provides a convenient and ideal device for improving an athlete's performance in punting, passing or kicking a football or the like.

Although the present invention has been described with reference to a single illustrated embodiment thereof, it should be understood that numerous other modifications and embodiments can be devised by those skilled in the art that will fall within the spirit and scope of the principles of this invention.

What is claimed as new and desired to be secured by Letters Patent of the United States is:

1. Practice apparatus for measuring the azimuth angle, an equivalent distance and the angle of elevation of projectile movement comprising:

a base including means for securing the same in a fixed position on the ground or other surface;

a tether line connected to said base and said projectile at opposite ends;

first measuring means for measuring the elevation of the projectile movement mounted on said base and including an arm mounted on said base for pivotal movement about a horizontal axis said arm having a free edge having an aperture through which said line passes;

second measuring means for measuring the azimuth angle of projectile movement mounted on said arm including an element mounted for pivotal movement about a vertical axis and having a free end having an aperture through which for said line passes for indicating the azimuth of said tether line when under tension by movement of said projectile including means for locking said second measuring means in its pivoted position when said line tension is released; and third measuring means mounted on said arm for indicating the amount of tension exerted on said line by movement of said projectile for providing an equivalent distance measurement.

2. The practice apparatus of claim 1 wherein said first measuring means includes a marker mounted for movement on an arcuate path around said horizontal axis in response to elevation of said tether line under tension.

3. The practice apparatus of claim 2 including a scale adjacent the path of said marker.

4. The practice apparatus of claim 1 wherein said arm includes an elongated slot for freely passing said tether line through a range of azimuth angles of said line relative to said axis.

5. The practice apparatus of claim 1 wherein said second measuring means includes a scale for indicating the angle of swing of said free end of said element effected by said tether line when tension by movement of said projectile.

6. The practice apparatus of claim 1 wherein said line includes an elastic portion connected on one end to said tether line and to said base on the other end, said third measuring means including a slidable marker operatively connected to said line so as to move said marker in an amount responsive to the tension exerted on said tether line by movement of said tether line by movement of said projectile.

7. The practice apparatus of claim 6 wherein said second measuring means and said third measuring means are slideably mounted on said arm for movement away from said pivot axis when said elastic portion is stretched by tension on said tether line.

8. The practice apparatus of claim 7 including scale means on said arm for indicating the amount of movement of said marker.

9. The practice apparatus of claim 1 including scale means for indicating the azimuth angle of said marker means.

* * * * *